US008931249B2

(12) United States Patent
Stephan et al.

(10) Patent No.: US 8,931,249 B2
(45) Date of Patent: Jan. 13, 2015

(54) SPINNING MACHINE AND METHOD FOR INTERRUPTING YARN PRODUCTION ON A SPINNING MACHINE

(75) Inventors: Adalbert Stephan, Beilngries (DE); Gernot Schäffler, Wäschenbeuren (DE); Evzen Pilar, Litomysl (CZ); Martin Novak, Usti nad Orlici (CZ); Vítezslav Kubes, Usti nad Orlici (CZ); Josef Ludvícek, Usti nad Orlici (CZ); Vladimir Krycner, Usti nad Orlici (CZ)

(73) Assignee: Rieter Ingolstadt GmbH, Ingolstadt (DE)

( * ) Notice: Subject to any disclaimer, the term of this patent is extended or adjusted under 35 U.S.C. 154(b) by 170 days.

(21) Appl. No.: 13/616,841

(22) Filed: Sep. 14, 2012

(65) Prior Publication Data

US 2013/0067878 A1 Mar. 21, 2013

(30) Foreign Application Priority Data

Sep. 21, 2011 (DE) ..... 10 2001 053 811

(51) Int. Cl.
*D01H 13/14* (2006.01)

(52) U.S. Cl.
CPC ..... *D01H 13/14* (2013.01)
USPC ..... 57/78; 57/263; 57/264

(58) Field of Classification Search
CPC ..... D01H 1/24; D01H 4/48; D01H 5/68; D01H 13/14; D01H 13/1691
USPC ..... 57/22, 202, 261, 263, 264, 78
See application file for complete search history.

(56) References Cited

U.S. PATENT DOCUMENTS

| | | | |
|---|---|---|---|
| 3,698,174 | A | 10/1972 | Boucek et al. |
| 4,054,024 | A | 10/1977 | Tsubata et al. |
| 4,104,854 | A | 8/1978 | Mikulecky et al. |
| 4,228,642 | A | 10/1980 | Dakin et al. |
| 4,777,790 | A | 10/1988 | Raasch |

(Continued)

FOREIGN PATENT DOCUMENTS

| | | |
|---|---|---|
| DE | 21 30 691 | 12/1972 |
| DE | 103 46 194 A1 | 4/2005 |

OTHER PUBLICATIONS

German Patent Office Search Report, May 14, 2012.

*Primary Examiner* — Shaun R Hurley
(74) *Attorney, Agent, or Firm* — Dority & Manning, P.A.

(57) ABSTRACT

A method interrupts yarn production on a spinning machine having at least one spinning point having an inlet for a fiber material and an outlet for the yarn made from the fiber material, and wherein the spinning machine comprises a delivery device for feeding the fiber material into the spinning point, a take-off device for drawing off the yarn out of the spinning point, a winding device for winding up the produced yarn, and a yarn monitoring unit for monitoring at least one yarn parameter. Yarn production is interrupted upon detecting a defined deviation of the monitored yarn parameter from a target value, upon changing bobbins at the winding device, and/or prior to switching off the spinning machine. The feed speeds of the delivery device, the take-off device, and the winding device are gradually reduced to a stop in order to interrupt the yarn production, wherein the reducing takes place such that the end of the produced yarn is located between the outlet of the spinning point and the winding device after the reducing is completed.

15 Claims, 8 Drawing Sheets

(56) References Cited

U.S. PATENT DOCUMENTS 4,777,791 A 10/1988 Wood et al.
4,845,936 A * 7/1989 Artzt et al. ..... 57/261
4,944,145 A 7/1990 Stahlecker
5,163,279 A * 11/1992 Stahlecker ..... 57/86
5,167,114 A * 12/1992 Stahlecker ..... 57/261
5,327,712 A * 7/1994 Dallmann et al. ..... 57/22
5,484,116 A * 1/1996 Horak et al. ..... 242/475.6
7,464,529 B2 * 12/2008 Stahlecker et al. ..... 57/263

* cited by examiner

SPINNING MACHINE AND METHOD FOR INTERRUPTING YARN PRODUCTION ON A SPINNING MACHINE

FIELD OF THE INVENTION

The invention relates to a method for interrupting yarn production on a spinning machine, wherein the spinning machine comprises at least one spinning point having an inlet for a fiber material and an outlet for the yarn made from the fiber material, and wherein the spinning machine comprises a delivery device for feeding the fiber material into the spinning point, a take-off device for drawing off the yarn out of the spinning point, a winding device for winding up the produced yarn, and a yarn monitoring unit for monitoring at least one yarn parameter (such as in the form of the yarn thickness or another parameter representative of the quality of the yarn), wherein the yarn production is interrupted upon detecting a defined deviation of the monitored yarn parameter from a target value, upon changing bobbins at the winding device, and/or prior to switching off the spinning machine. The invention further relates to a spinning machine for producing a yarn, wherein the spinning machine comprises at least one spinning point having an inlet for a fiber material and an outlet for the yarn produced from the fiber material, and wherein the spinning machine comprises a delivery device for feeding the fiber material into the spinning point, a take-off device for drawing off the yarn from the spinning point, a winding device for winding up the produced yarn, and a yarn monitoring unit for monitoring at least one yarn parameter.

BACKGROUND

In general, stopping the spinning process in case of a detected yarn defect by interrupting fiber infeed is known, for example for rotor or air-jet spinning machines. The end of the yarn on the winding side is then wound up by the bobbin continuing to turn, while the cut end of the yarn is drawn off by vacuum. When spinning is subsequently restarted by piecing, the end of the yarn on the bobbin must then be detached from the surface of the bobbin, such as by means of a corresponding suction device, in order to be able to feed it back against the actual spinning direction to the spinning point again. Locating the end of the yarn is, however, typically very time-consuming and is also afflicted by a mechanical effect, particularly for very fine and highly spun yarns, so that the process of piecing can lead to a significant delay in continuing the spinning process.

SUMMARY OF THE INVENTION

An object of the present invention is therefore to propose a method and a spinning machine allowing the end of the yarn to be located more quickly and easily after a controlled interruption of yarn production. Additional objects and advantages of the invention will be set forth in part in the following description, or may be obvious from the description, or may be learned through practice of the invention.

According to the invention, a method is characterized in that the feed speeds of the delivery device, the take-off device, and the winding device are gradually reduced to a stop in order to interrupt the yarn production, wherein the reducing takes place such that the end of the produced yarn is located between the outlet of the spinning point and the winding device after the reducing is completed. In contrast to the prior art method described above, wherein the end of the produced yarn is inevitably wound onto the bobbin until spinning is stopped, because the bobbin cannot be stopped abruptly due to the inertia thereof, such winding can be effectively prevented by the method according to the invention. The operated spinning machine is preferably an air-jet or rotor spinning machine. Both types of spinning machine are characterized in that particular conditions must be maintained with respect to the feed speed of the delivery device and take-off device. These speeds must exceed particular threshold values for producing a high-quality yarn, in order to be able to impose the desired twist of the fiber material in the interior of the spinning chamber. If the indicated feed speeds are reduced gradually, that is, preferably within a few seconds, then ultimately the point is reached at which no more yarn production takes place, because either too little fiber material is transported into the spinning chamber, or the yarn is drawn off from the spinning chamber too fast relative to the delivery of the fiber material. At this point in time, an end of the yarn is ultimately produced and moves according to the residual feed speed of the take-off device in the direction of the winding device. According to the invention, the feed speeds are ultimately reduced to zero in the course of interrupting the yarn production, such that the yarn end is located between the outlet of the spinning point and the winding device after the individual feed devices have stopped. The yarn formation within the spinning chamber is thus interrupted gradually, and thus not abruptly, reducing the individual feed speeds. The corresponding end of the yarn is thus produced by correspondingly matching the individual feed speeds. Yarn production is thereby interrupted, so that the yarn separates from the subsequent fiber material. Because the feed speeds at said point are significantly lower than during the actual yarn production, the winding device can also be slowed at a targeted rate, so that a defined end state arises wherein the end of the yarn is located at the described position, and thus not on the surface of a corresponding bobbin of the winding device. In order to ensure uniform winding of the produced yarn on the bobbin even at reduced feed speeds, it can also be useful to slow down (or to stop in the middle) any device for guiding the yarn. The end of the yarn can then be captured at the indicated position by the operator or a robotic unit and prepared for further piecing, or moved to the corresponding location intended for piecing, without requiring a prior search process on the bobbin surface for finding the end of the yarn. Similarly, the above applies to rotor spinning machines as well, wherein the yarn production is also interrupted if the corresponding feed speeds fall below particular threshold values.

It is further advantageous if the delivery device is formed by a pair of delivery rollers and/or the take-off device is formed by a pair of take-off rollers. Such rollers allow precise control of the corresponding feed speeds by adjusting the rotary speeds thereof accordingly. The rotary speeds can thus be reduced within a prescribed time span in the course of the method according to the invention, typically between one and a plurality of seconds, without causing the yarn to tear.

It is advantageous if the end of the produced yarn is located between the outlet of the spinning point and the take-off device after the feed speeds are completely reduced. The end of the yarn is located in this case at a position that is easily accessible from the outside. The end of the yarn is also reliably prevented from entering the area of the winding device. In this manner, reliable gripping of the end of the yarn by a gripper device, such as a robot, is made possible, wherein the end of the yarn always reaches a stop at a previously defined position that is preferably stored in the controller of the gripping device.

It is further advantageous if the feed speeds are first reduced to defined levels at which yarn production is no longer possible within the spinning point, and the take-off device and preferably also the winding device are then run at the corresponding feed speeds until the end of the produced yarn is located at a defined position between the outlet of the spinning point and the winding device. It is thus ensured that the end of the yarn produced by interrupting yarn production is transported outward at the residual feed speed. The feed speed is thereby lower than during the actual yarn production, so that the subsequent motion of the end of the yarn from the spinning point into the area between the outlet thereof and the winding device can be reliably controlled.

It is further advantageous if the feed speeds are reduced continuously, preferably linearly. Abrupt changes in speed and potential tearing of the yarn are thereby avoided. In addition to a linear reduction in speed, any other arbitrary reduction is also conceivable, of course. Even if it is entirely possible to reduce to the feed speeds of the delivery device and the take-off device simultaneously, and to stop said devices at the same point in time, it has been found to be advantageous to reduce the corresponding feed speeds at staggered times. For example, it is advantageous to reduce the feed speed of the delivery device prior to reducing the feed speed of the take-off device. It is further advantageous to stop the take-off device after stopping the delivery device, in order to ensure that the end of the produced yarn is located at the location of the spinning machine according to the invention. As a result it is therefore advantageous if the drives of the delivery device and the take-off device can be actuated separately.

It is advantageous if the yarn is fixed by means of a yarn storage after the reducing of the feed speeds is complete. A yarn storage comprises, for example, a hollow cylinder connected to a vacuum source such that a vacuum can be generated in the hollow cylinder as needed (for example by applying the vacuum source in a target manner.) If the take-off device is stopped later than the winding device, then yarn drawn off from the spinning point after the winding device has stopped can be sucked into the hollow cylinder and thus retained at a defined position. When spinning is restarted by piecing later, the operator or a corresponding service robot can then grip the yarn segment located between the yarn storage and the winding device and start piecing. The yarn segment present in the yarn storage can thereby be drawn out of the yarn storage with the remaining yarn. It is also conceivable, however, that the corresponding yarn segment is cut off prior to piecing, and is disposed of by means of an exhaust device connected to the yarn storage.

It is further advantageous if the yarn is fixed by means of the take-off device after reducing the feed speeds. If the take-off device is corresponding take-off rollers, then the yarn can be reliably clamped between the corresponding rollers. This requires only that the take-off rollers are stopped before the end of the yarn passes through them. If the end of the yarn is captured manually or automatically for piecing, then the clamping is relieved and the end of the yarn is released again, wherein prior to the release a (renewed) defined transport of the end of the yarn by the take-off rollers can take place in or opposite to the spinning direction.

It is also advantageous if the end of the produced yarn is captured by means of a robot after interrupting the yarn production, fed back to the spinning point, and connected to the fiber material during a piecing process. To this end, the robot comprises corresponding yarn handling devices, such as a gripper device and/or corresponding suction or blowing devices, in order to guide the end of the yarn through the outlet of the spinning point opposite to the actual spinning direction to the area where the actual piecing process is to take place, which can also be performed by means of the robot. It is, of course, also possible to equip the individual spinning points with separate yarn handling devices each individually associated with the spinning points, so that the use of a robot may not be necessary. It is ultimately also conceivable that the end of the produced yarn is not connected to the fiber material fed into the spinning point in the course of a piecing process, but rather used for forming a fixed end of the thread (wherein the end of the yarn is placed at a particular location on the full bobbin, typically at the side edge thereof.) In order to make accidental release of the correspondingly placed end of the yarn more difficult during bobbin transport, the yarn can be unwound from the full bobbin by a certain amount prior to placement. The unwound segment is then wrapped around the previously non-wound side part of the bobbin core several times and then fed back to the bobbin surface and placed to the side thereof.

It is further advantageous if the yarn is captured by the robot between the outlet of the spinning point and the winding device prior to the piecing process. This allows the robot to fix of the end of the yarn early, so that the entire yarn feedback and subsequent piecing process can take place in a controlled manner. While the end of the yarn can be threaded through the spinning point from the back, it is also conceivable that the spinning point is designed such that a part can be removed or opened in order to be able to place the yarn into the spinning point.

It is further advantageous if the piecing process takes place outside of the spinning point, particularly between the delivery device and a roller pair of a drawing unit. In this area, the fiber material to be spun is typically fixed by means of corresponding delivery rollers, or in the case of an air-jet spinning machine, by means of a roller pair of a drawing unit connected upstream, after the delivery device has been stopped. Because contact between the fiber material and the returned end of the yarn must be accomplished when piecing, it is thus convenient to perform the piecing process in this area.

It is also advantageous if the fixing of the yarn is ended before or while it is captured by the robot. Tearing of the yarn at this stage can thereby be prevented. Alternatively, however, it is also possible that the fixing is ended only after the robot has captured the yarn. Such a time sequence would be conceivable, for example, if a (vacuum) thread storage is used. If the fixing takes place by means of corresponding take-off rollers, then it would be further conceivable in this context to have the robot raise one of the rollers off of the counter-roller during or immediately after gripping the yarn. Alternatively, it would also be possible to drive the take-off rollers in reverse after gripping the end of the yarn, so that the yarn is actively transported in the direction of the spinning point. If needed, the take-off rollers can also be driven in the opposite direction, of course, so that the end of the produced yarn can be moved to the intended position in all cases.

It is particularly advantageous if at least the yarn segment produced during the reduction of the feed speeds is removed prior to the piecing process. As a rule, the yarn that is produced during the reduction of the individual feed speeds will namely be of lower quality. It can then be necessary for removal to operate the winding device prior to piecing such that the yarn already wound on the bobbin is unwound until the bobbin contains only yarn that was produced prior to the reduction in the feed speeds. It would also be possible to accumulate the lower-quality yarn in the yarn storage described above and to cut it off prior to the piecing process. A separate cutting device can be used to this end, for example.

It is also noted that it can also be advantageous if a relatively thick yarn is produced immediately prior to the interruption of yarn production according to the invention. The yarn can then be found and/or captured particularly quickly and reliably by the robot.

It is further advantageous if the position of the end of the produced yarn is determined by means of a sensor. Such a sensor can be positioned, for example, in the area of the outlet of the spinning point or between the take-off device and the winding device. The end of the thread can also be detected by means of light beams or mechanically. As a result, it is possible to determine by means of the sensor that the interruption of yarn production in the sense of the invention was successful, wherein the sensor can determine other parameters in addition to or as an alternative to the indicated position, such as the general presence of yarn at predetermined segments of the spinning machine.

It is further advantageous if the reduction in the feed speeds takes place in conjunction with signals transmitted by the sensor or sensors to a control and/or regulation unit. If, for example, the end of the yarn is detected by a sensor located between the outlet of the spinning point and the take-off device, then the feed speed of the take-off device and, if necessary, also of the winding device is reduced, such that the end is located at the previously defined position, such as in the area of the take-off rollers of an air-jet spinning machine, after the relevant yarn transport devices have come to a stop. By using the sensor indicated, the end of the yarn is ensured to always be located at the same position within the spinning machine after interrupting yarn production, and thus to be able to be reliably manually or automatically captured and fed to the piecing process.

Not least, it is advantageous if the reduction of the feed speeds takes place as a function of physical and/or chemical properties of the fiber material (type of fiber material, strength, fiber length, etc.) and/or characteristic parameters of the spinning machine, in order to be able to optimize for particular conditions. The characteristic parameters of the spinning machine can thereby include rotary speeds, delivery speeds, or corresponding parameters of the drawing unit in use. Humidity and/or temperature values at defined locations of the spinning machine or in the rooms around the spinning machine can also be taken into consideration.

The spinning machine according to an embodiment of the invention is ultimately characterized in that said machine comprises a control and/or regulation unit designed for operating the spinning machine in accordance with one or more aspects of the preceding description. With respect to each of the advantages and potential variations, reference is made to the previous description.

Ultimately, further method steps or characteristics of the spinning machine can be implemented, resulting in an advantageous delineation from the known state of the art.

It would be conceivable, for example, that in case of a yarn break (that is, an interruption of the spinning process that was not initiated in a controlled manner), yarn handling devices would be used that can grip the end of the yarn that may have been wound up on the bobbin of the corresponding winding device and can feed the end of the yarn to the subsequent piecing process. The yarn handling devices can thereby be part of a service robot patrolling between the corresponding spinning points, or can be individually associated with each spinning point.

The yarn also does not necessarily have to be captured at the end thereof prior to the piecing process. It is therefore also conceivable to grip the yarn between the end segment thereof (preferably fixed by means of the take-off rollers) and the bobbin of the winding device.

With respect to the sensor described above (which can preferably detect the successful fixing of the end of the yarn or another segment of the yarn, in addition to the position of the end of the yarn), it is noted that the measured values of the same can be used as the basis for further processing. For example, the introduction of a piecing process makes sense only if the yarn production has been successfully interrupted, and the end of the yarn has been fixed correspondingly.

A further potential for optimizing the method according to the invention or the described spinning machine can be achieved in that the method for interrupting the yarn production is implemented to be "self-teaching." It would be conceivable, for example, that individual parameters (amount and start of the reduction of the corresponding speeds, time of stopping the delivery device, the take-off device, and/or the winding device, characteristic parameters of the piecing process, etc.) are adapted as a function of the data provided by the corresponding sensors in a preferably continuous process performed by the control and/or regulation device of the spinning machine.

BRIEF DESCRIPTION OF THE DRAWINGS

Further advantages of the invention are described in the following implementation examples. They show.

DETAILED DESCRIPTION

Figure 1:
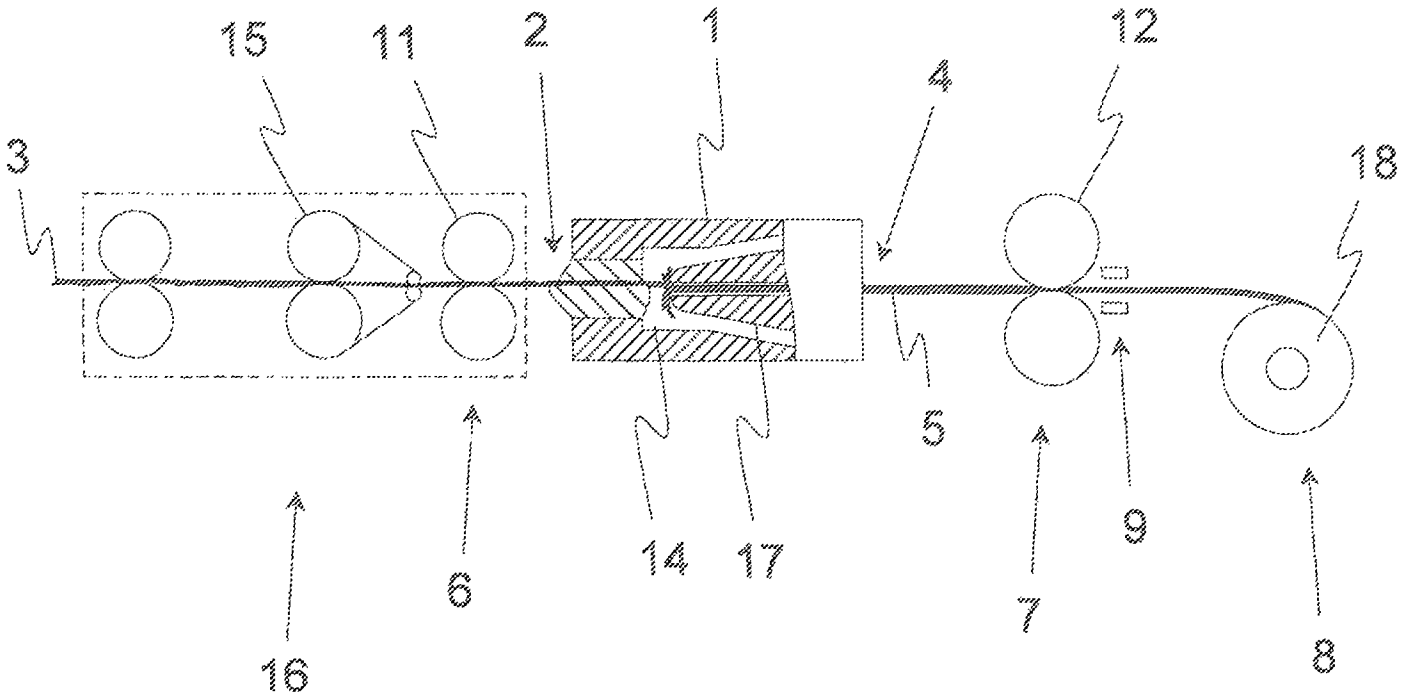
FIG. 1: a side view of a segment of a spinning machine according to an embodiment of the invention during yarn production.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a schematic view of a segment of an exemplary air-jet spinning machine according to the invention. The air-jet spinning machine in the example shown comprises a drawing unit 16 supplied with a fiber material 3, such as in the form of a doubled sliver. The air-jet spinning machine shown further comprises a spinning point 1 spaced apart from the drawing unit 16 and having an inlet 2 for the fiber material 3 and an internal vortex chamber 14. The fiber material 3 is introduced into the spinning point 1 by means of a delivery device 6 implemented as a delivery roller pair 11, which in turn can be part of the drawing unit 16.

The fiber material 3, or at least part of the fibers of the fiber material 3, are provided with a rotation within the vortex chamber 14 for producing the desired yarn 5. The rotation thereby arises from the targeted air flow in the area of a spindle 17, wherein the air flow is generated by nozzles[,] (not shown)[,] opening tangentially into the vortex chamber 14.

The spinning machine shown further comprises a take-off device 7 formed by a take-off roller pair 12 and a winding device 8 connected downstream of the take-off roller pair 12 for the yarn 5 drawn off out of the spinning point 1 through the outlet 4.

The spinning machine is finally equipped with a yarn monitoring unit 9 monitoring previously defined parameters of the yarn 5 (such as the yarn thickness, yarn strength, or other parameters representative of the quality of the yarn 5.) The yarn monitoring unit 9 thereby operates preferably in a non-contacting manner.

The device according to the invention need not necessarily comprise a drawing unit 16 as is shown in FIG. 1. The take-off roller pair 12 is also not absolutely necessary. The spinning machine according to the invention can also be implemented as a rotor spinning machine, wherein the spinning point 1 in this case comprises a rotor in place of the spindle 17 shown, by which the yarn 5 produced at the tip of the spindle 17 is drawn off out of the spinning point 1.

Figure 2:
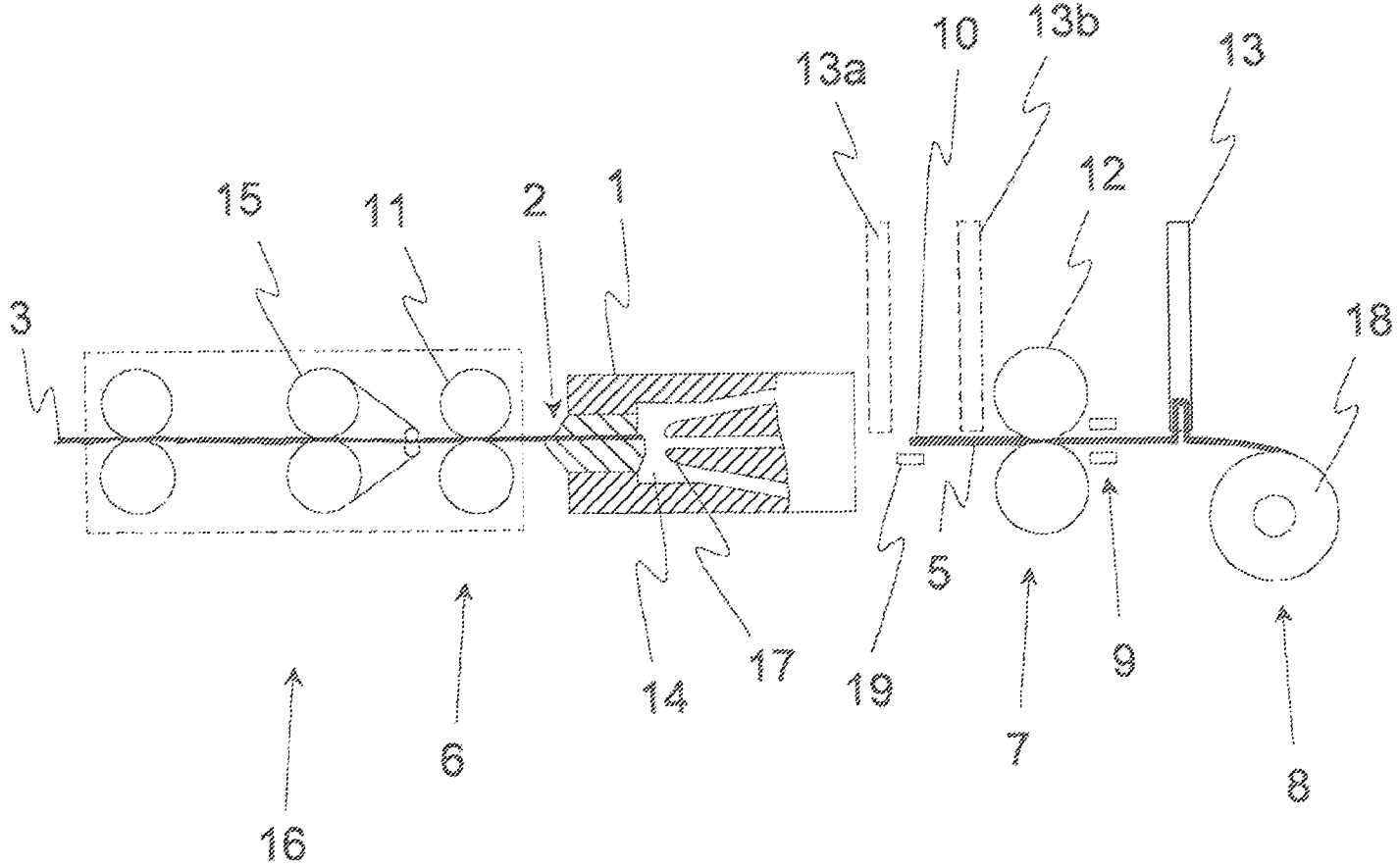
FIG. 2: a side view of a segment of a spinning machine according to an embodiment of the invention after interruption of yarn production.

The method according to the invention for interrupting the yarn production can be seen in the combination of FIGS. 1 and 2. FIG. 1 first shows the route of the fiber material 3 and the yarn 5 produced in the area of the spindle 17 during the actual spinning process.

If a defined deviation of the monitored parameter or parameters from corresponding target values is detected by means of the yarn monitoring unit 9 (which can also be located at a different position), or if a bobbin change is imminent, then the feed speeds of the delivery device 6, the take-off device 7, and the winding device 8 are gradually reduced. The reduction can also take place before the spinning machine is switched off.

The reduction does not have to be simultaneous or continuous. In any case, the corresponding feed speeds should be reduced, however, such that the spinning process can be maintained for as long as possible. Tearing of the yarn 5, as is typical for the state of the art, can be prevented in this manner. The goal of reducing the feed speeds, rather, is that the stable spinning process collapses when the speed drops below defined feed speeds, and no more yarn 5 is produced from the fiber material 3 after a particular point in time. At said point in time, the desired interruption of yarn production occurs, wherein the yarn is released from the yarn 5 without a separate application of force. This can be achieved, for example, in that the feed speed of the delivery device 6 is reduced until the amount of fiber material 3 being delivered is not sufficient for making yarn 5 out of said fiber material. It is also possible to reduce the feed speed of the take-off roller pair 12 more slowly (or if needed, also more quickly) than the feed speed of the delivery roller pair 11 and/or the winding device 8.

After the yarn production has been interrupted, the take-off roller pair 12 should be operated further for a brief period of time, until the resulting end 10 of the yarn 5 reaches a position as shown in FIG. 2, after the final stop of the delivery device 6, the take-off device 7, and the winding device 8. Part of the produced yarn 5 can thereby be retained in a yarn storage 13 (such as in the form of a tube connected to a vacuum source) shown only in FIG. 2, in order to prevent the yarn 5 produced during the reduction of the feed speeds from being wound up on the winding device 8 (the yarn storage 13 is of course not shown to scale, but only schematically.) The yarn storage 13, as indicated by the two yarn storages 13*a*, 13*b* shown in dashed lines, can also be disposed at various positions within the spinning machine, such as between the take-off roller pair 12 and the winding device 8, between the sensor 19 and the winding device 8, or between the spinning point 1 and the sensor 19.

In order to be able to stop the take-off device 7 or the winding device 8 at the correct point in time, it can be advisable to equip the spinning machine with a sensor 19 as shown in FIG. 2. This sensor is designed to be able to detect the end 10 of the yarn 5. If the end 10 of the yarn 5 ultimately reaches the sensor 19, then the take-off device 7 and the winding device 8 can be stopped either immediately or after a certain time by means of the corresponding control and/or regulation unit, so that the end 10 of the yarn 5 is ultimately located between the outlet 4 of the spinning point 1 and the take-off device 7 or between the take-off device 7 and the winding device 8.

The yarn 5 can further be fixed by means of the take-off roller pair 12 after interrupting yarn production, as is also shown in FIGS. 1 and 2, in addition to or alternatively to the yarn storage 13.

As a result, the end 10 of the yarn 5 required for the piecing process is located at a defined position between the outlet 4 of the spinning point 1 and the bobbin 18 of the winding device 8, so that the piecing process can be started without previously having to search for the end 10 of the yarn 5, such as on the surface of a bobbin 18 of the winding device 8 (as is typical in the state of the art.)

For the piecing process, the yarn 5 is then gripped and prepared for the subsequent piecing process by means of a service robot, by means of a yarn handling device dedicated for the spinning point, or manually at the corresponding position at which the end 10 of the yarn 5 is located (such as between the end 10 of the yarn 5 and the bobbin 18 of the winding device 8.) To this end, for example, the end can be inserted into the spinning point 1, opposite the actual spinning direction, between the inlet 2 of the spinning point 1 and the delivery device 6, or between the delivery device 6 and an adjacent roller pair 15 of the drawing unit 16. There the end is ultimately brought into contact with the fiber material 3 and fed back into the spinning point 1. The spinning process starts again from the beginning.

Figure 3:
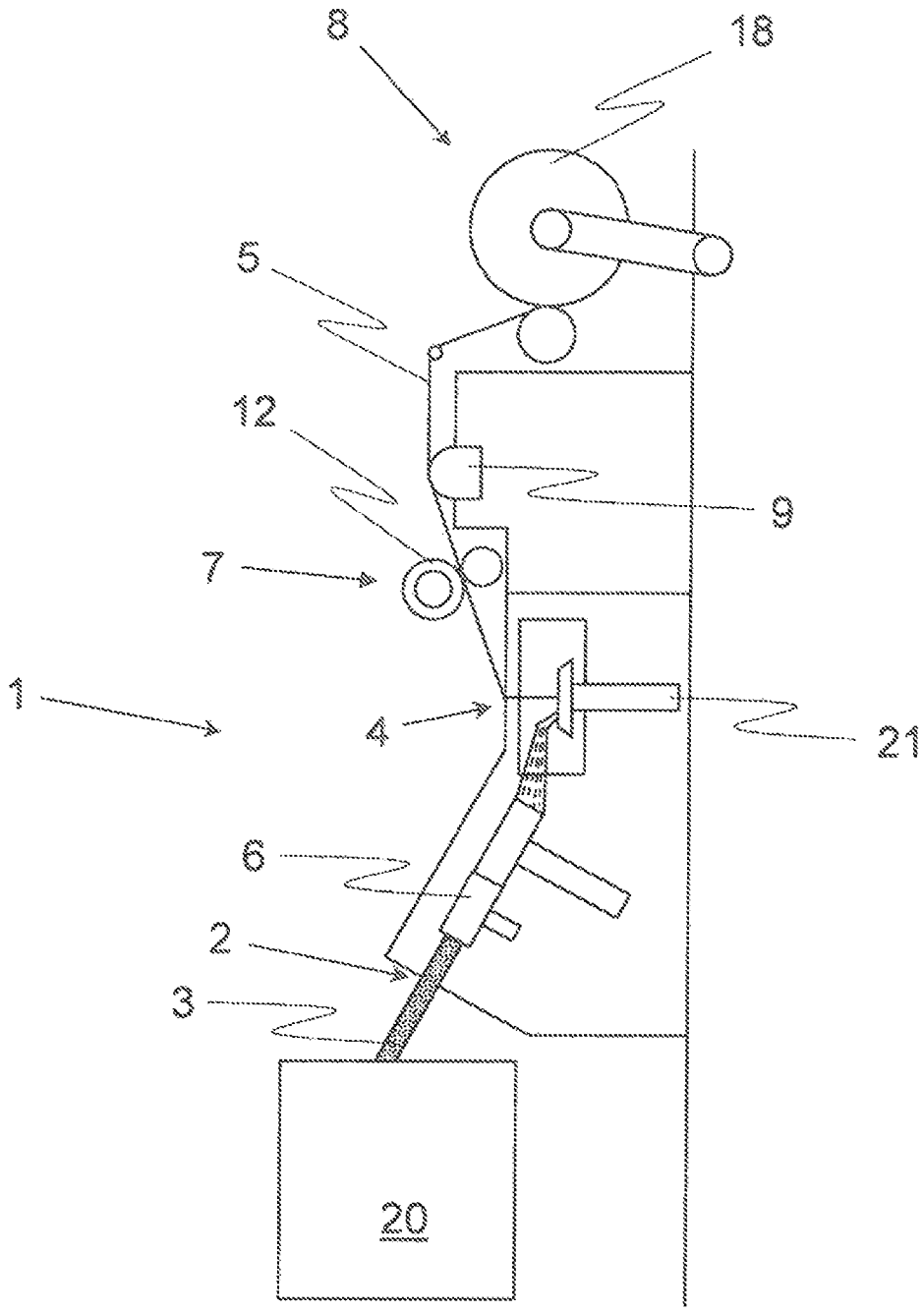
FIG. 3: a side view of a segment of a further spinning machine according to the invention during yarn production.

Finally, FIG. 3 shows a further spinning machine according to the invention in the form of a rotor spinning machine. For such a rotor spinning machine, a plurality of spinning points 1 are usually disposed adjacent to each other in the longitudinal direction of the machine (that is, perpendicular to the plane of the drawing.) A fiber material 3 is fed to each spinning point 1 in a known manner from a spinning can 20, broken down into individual fibers in the spinning point 1, and fed to a spinning element, in the present case a spinning rotor 21. The yarn 5 produced in the spinning rotor 21 is then drawn out of the spinning point 1 by a take-off device 7, for example comprising a take-off roller pair 12, and wound up onto a bobbin 18 by means of a winding device 8.

As described in connection with the air-jet spinning machine shown in FIGS. 1 and 2, the method according to the invention for interrupting the yarn production can also be performed on the rotor spinning machine shown in FIG. 3. Here as well the feed speeds of the delivery device 6, the take-off device 7, and the winding device 8 can be reduced gradually to a stop. The reduction thereby also takes place such that the end 10 (not shown in FIG. 3) of the produced yarn 5 is located between the outlet 4 of the spinning point 1 and the winding device 8 after the reduction is complete.

It is conceivable thereby that the end 10 of the produced yarn 5 is located between the outlet of the spinning point 1 and the take-off roller pair 12 and is fixed in said position thereby after the interruption of the yarn production. Alternatively, however, the yarn production can also be interrupted such that the yarn 5 is finally located between the take-off roller pair 12 and the winding device 8. The end 10 of the produced yarn 5 can then be gripped by means of a yarn handling device and fed to the subsequent piecing process, known from the state of the art, wherein the yarn handling device in turn can be part of a patrolling service robot, or can be individually associated with each spinning point 1.

Of course, for the case of a rotor spinning machine as well, one or more intermediate storages for the yarn 5 can be provided, such as between the take-off roller pair 12 and the winding device 8. In this context, reference is made to the previous and following embodiments for corresponding yarn storages 13.

After the end 10 of the yarn 5 has finally been captured by a corresponding gripper or a comparable device, the fixation is released and the end 10 of the yarn 5 can then be displaced opposite to the actual spinning direction through the outlet 4 of the spinning point 1, back into the area of the spinning rotor 21. There, the end is brought into contact with the fiber material 3 fed in from below, optionally after a yarn preparation preceding said displacement. Alternatively, the piecing process can also take place outside of the spinning point 1, of course, such as between the outlet 4 and the take-off rollers 12.

Figure 4:
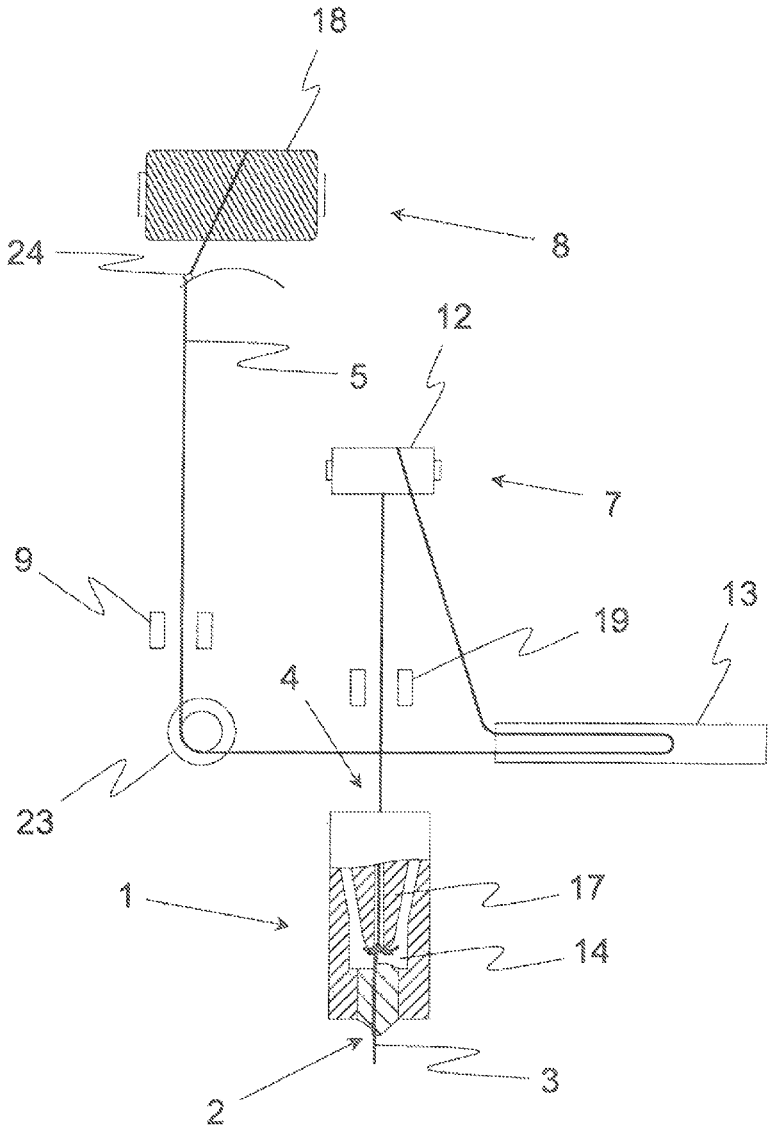
FIG. 4: a side view of a segment of a further spinning machine according to the invention during yarn production.

A further advantageous refinement of the invention can be seen in the combination of FIGS. 4 through 7. In contrast to the spinning machine shown in FIGS. 1 and 2, a yarn storage 13 is disposed between the spinning point 1 and the take-off roller pair 12, in which the yarn 5 is accumulated intermediately during the spinning process. As can be seen in FIG. 4, the yarn 5 runs in this stage from the outlet 4 of the spinning point 1 by means of the take-off roller pair 12 and from there into the yarn storage 13. In order to be sure that the yarn 5 can be wound up on the bobbin 18 of the winding device 8 in a controlled manner, despite the zero-tension intermediate accumulation in the yarn storage 13 (which is preferably connected to a vacuum source), a yarn brake 23, shown only schematically, is further provided, holding the yarn 5 under an adjustable tension in the area ahead of a corresponding yarn guide 24.

The advantage of this type of yarn guidance is that, in case of the interruption of yarn production according to the invention within the yarn storage 13, a type of yarn buffer is always available. Variations during the reduction of the speed of the rollers participating in the interruption can therefore be compensated for in a simple manner.

Figure 5:
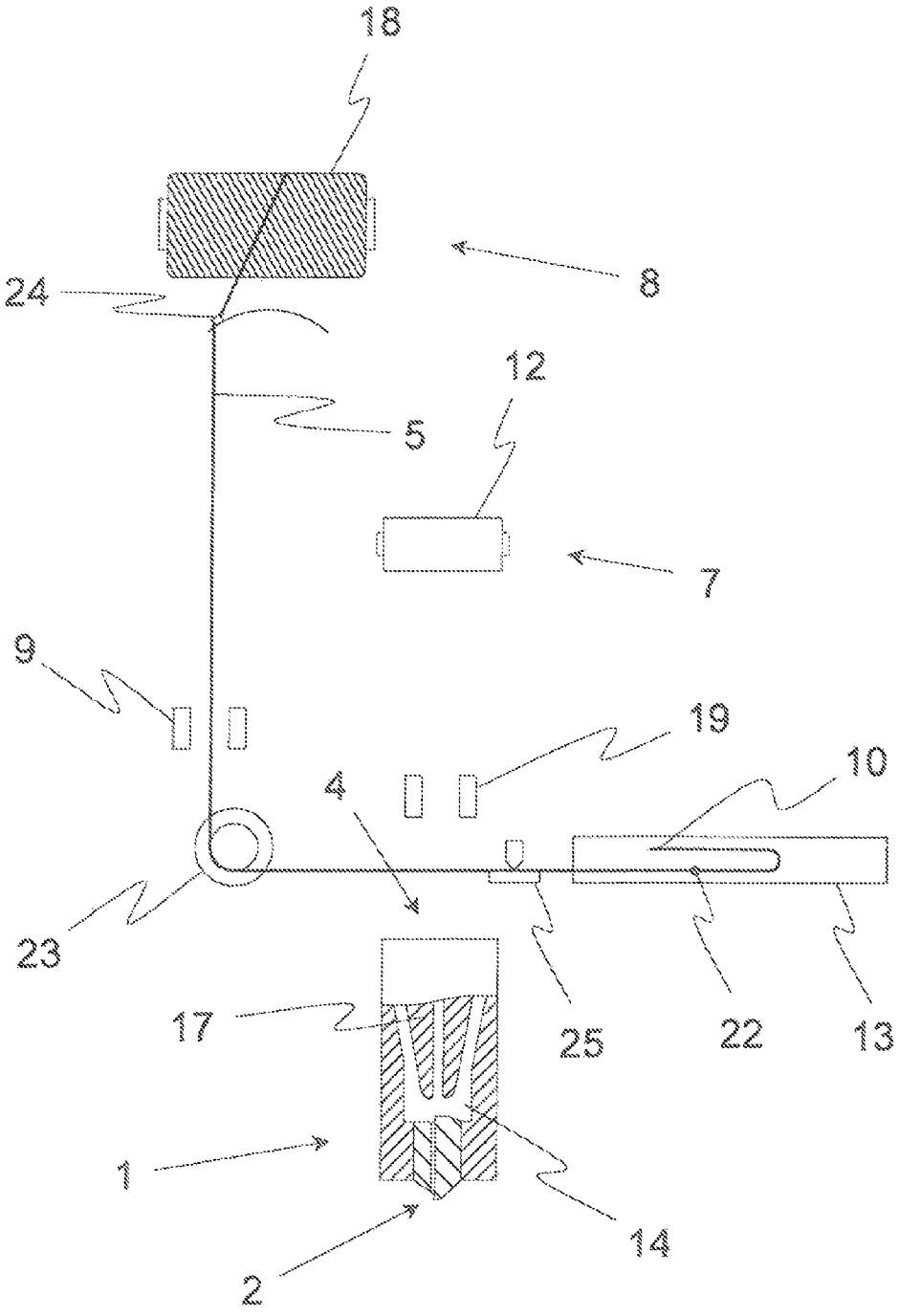
FIG. 5: the spinning machine according to FIG. 4 after interruption of yarn production.

FIG. 5 shows the described spinning machine in the state after the interruption of yarn production. The end 10 of the produced yarn 5 is located within the yarn storage 13, for example, wherein the winding device 8 has already been stopped, after the end 10 of the yarn 5 has passed the sensor 19 and the take-off roller pair 12 by a certain continued run.

Figure 6:
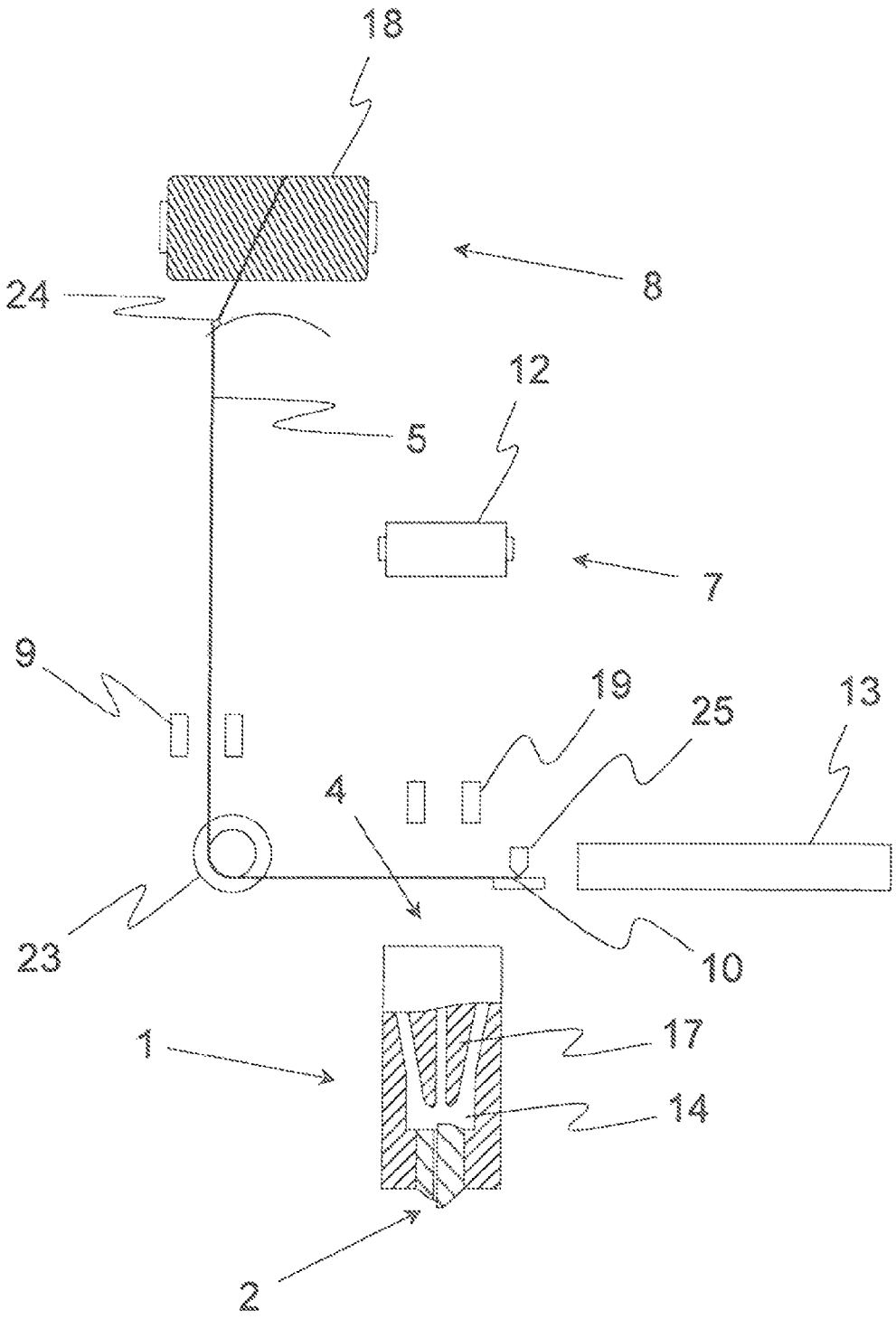
FIG. 6: the spinning machine according to FIGS. 4 and 5 after removing a yarn defect.
Figure 7:
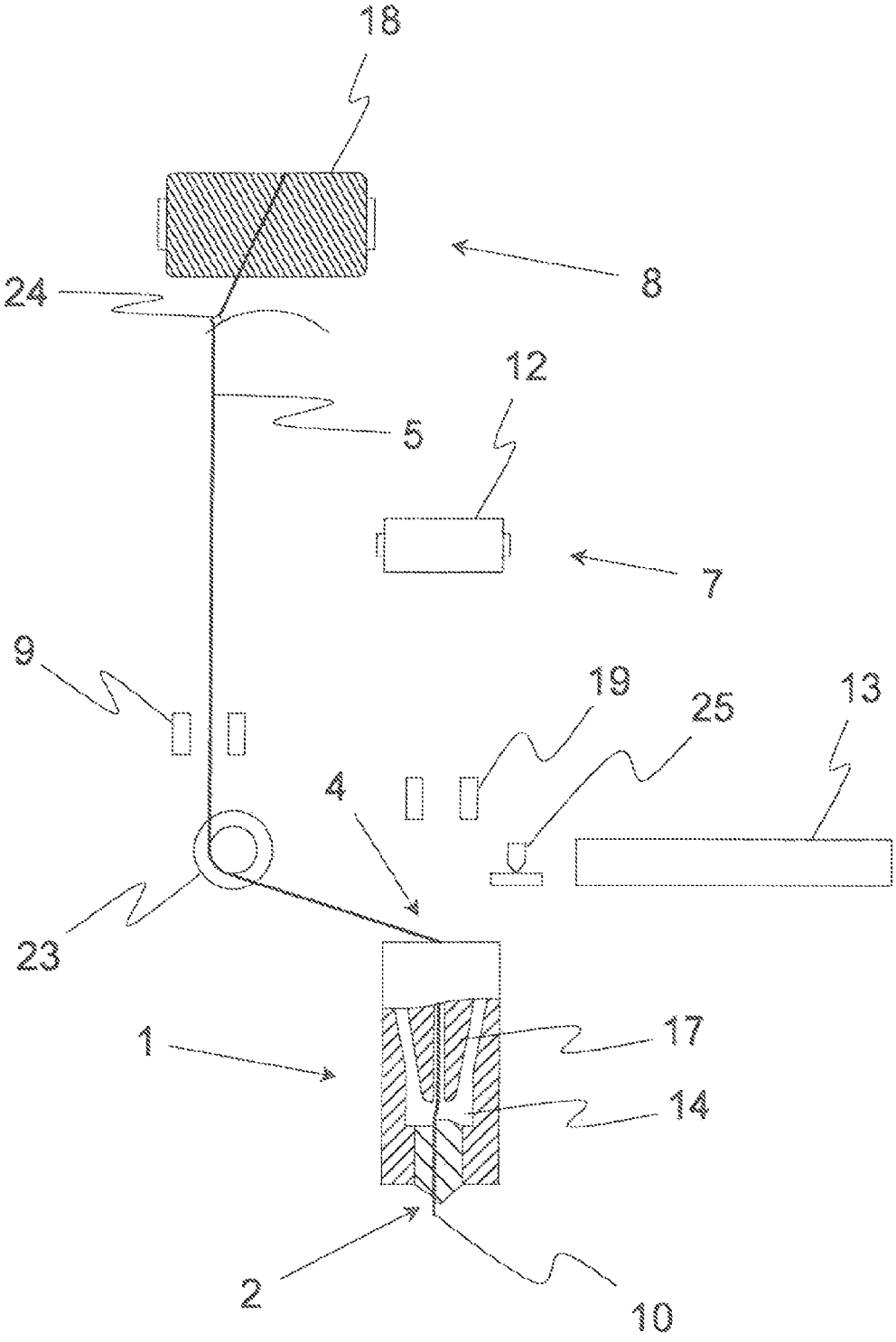
FIG. 7: the spinning machine according to the FIGS. 4 through 6 during feeding of the yarn back through the spinning point.

If a yarn defect 22 was the cause of the interruption of the yarn production, said defect can now be removed by a cutting unit 25 shown in FIGS. 5 through 7. To this end, the end 10 of the yarn 5 comprising the yarn defect 22 is cut off and sucked via the yarn storage 13.

A part of the yarn 5 is then unwound from the bobbin 18 by reversing the same, so that the end 10 of the yarn 5 is transported through the same, such as by means of the vacuum applied to the vortex chamber 14, and can be fed to the subsequent piecing process.

Figure 8:
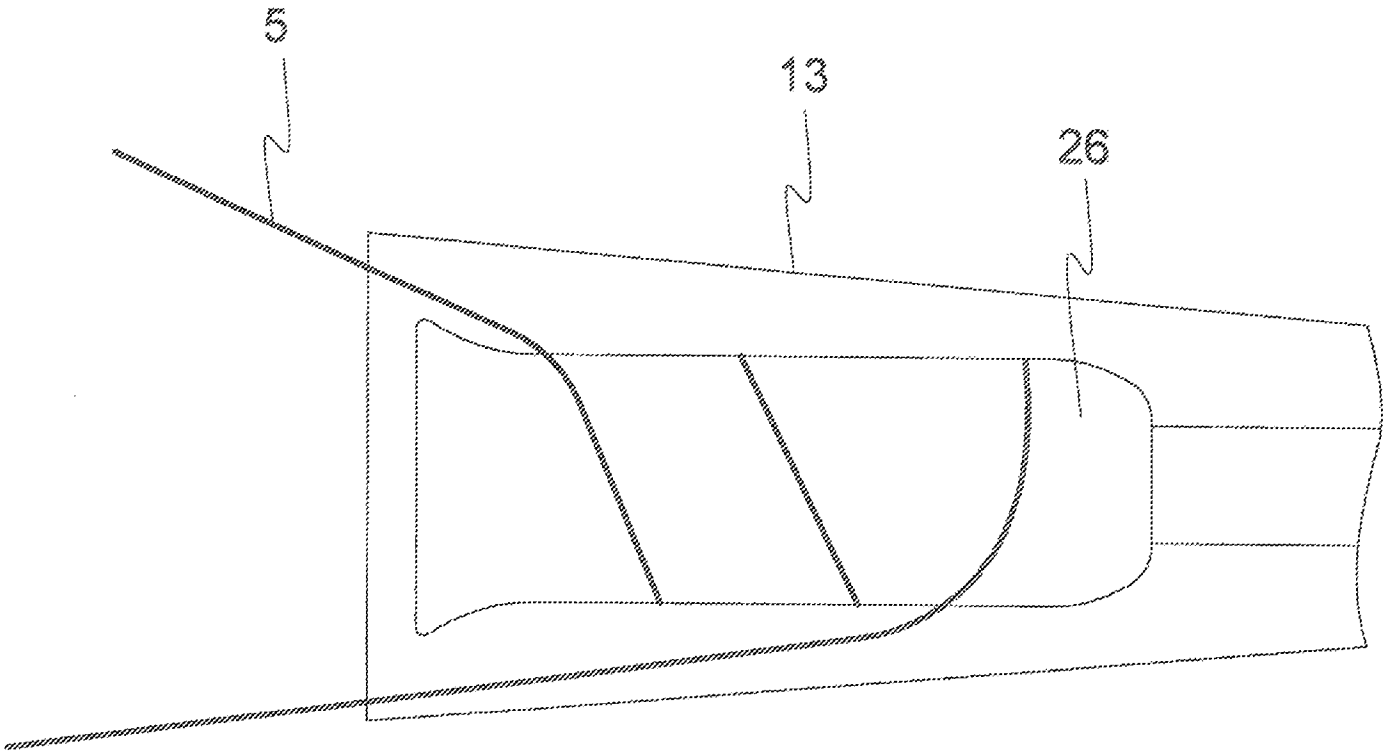
FIG. 8: a yarn storage.

FIG. 8 finally shows an alternative to the previously described yarn storage 13. In addition or alternatively to a connection to a vacuum source, not shown, said storage comprises a yarn carrier 26 on which the yarn 5 can be wound and unwound again for the purpose of intermediate storage. The yarn storage 13 can take on a significantly greater quantity of yarn in said manner without being significantly increased in size.

The invention is also not limited to the embodiments shown. Rather, any and all combinations of the individual features described, as shown in the figures or described in the claims or description, and to the extent that a corresponding combination appears possible and sensible, are subject matters of the invention.

The invention claimed is:

1. A method for interrupting yarn production on a spinning machine, wherein the spinning machine includes:

a spinning point having an inlet for a fiber material and an outlet for yarn made from the fiber material;

a delivery device for feeding the fiber material to the spinning point;

a take-off device for drawing off the yarn out of the spinning point;

a winding device for winding up the produced yarn; and a yarn monitoring unit of monitoring a yarn parameter, the method comprising:

interrupting yarn production upon any one of detection of a defined deviation of the yarn parameter by the yarn monitoring unit from a target value, upon changing bobbins at the winding device, or prior to switching off the spinning machine;

for yarn interruption, gradually reducing the feed speeds of the delivery device, the take-off device, and the winding device to a stop, wherein the reduction of feed speeds is controlled so that an end of the produced yarn is located between the outlet of the spinning point and the winding device after the speed reduction is complete.

2. The method as in claim 1, wherein the delivery device includes a delivery roller pair, and the take-off device includes a take-off roller pair.

3. The method as in claim 1, wherein the end of the produced yarn is located between the outlet of the spinning point and the take-off device after the speed reduction is complete.

4. The method as in claim 1, wherein the feed speeds are first reduced to defined levels at which yarn production is not possible in the spinning point, and thereafter the take-off device and the winding device are then run at their respective defined level speeds until the end of the produced yarn is located at a defined position between the outlet of the spinning point and the winding device.

5. The method as in claim 1, wherein the feed speeds are reduced continuously to a stop.

6. The method as in claim 1, wherein the yarn is fixed in position by a yarn storage device after the reduction of the feed speeds is complete.

7. The method as in claim 1, wherein the yarn is fixed in position by the take-off device after the reduction of the feed speeds is complete.

8. The method as in claim 1, wherein the end of the produced yarn is captured by a robot after interruption of yarn production, fed back to the spinning point, and connected to the fiber material during a piecing process.

9. The method as in claim 8, wherein the end of the produced yarn is captured by the robot between the outlet of the spinning point and the winding device.

10. The method as in claim 8, wherein the piecing process takes place outside of the spinning point between the delivery device and a drawing unit.

11. The method as in claim 8, wherein a yarn segment produced during reduction of the feed speeds is removed prior to the piecing process.

12. The method as in claim 1, wherein position of the end of the produced yarn is determined by a sensor.

13. The method as in claim 12, wherein reduction of the feed speeds is controlled as a function of a signal from the sensor that determines the end of the produced yarn.

14. The method as in claim 1, wherein reduction of the feed speeds is controlled as a function of a chemical or physical property of the fiber material.

15. A spinning machine, comprising:

a spinning point having an inlet for a fiber material and an outlet for yarn made from the fiber material;

a delivery device for feeding the fiber material to the spinning point;

a take-off device for drawing off the yarn out of the spinning point;

a winding device for winding up the produced yarn;

a yarn monitoring unit of monitoring a yarn parameter; and wherein the spinning machine is configured for interruption of yarn production in accordance with the method of claim 1.

* * * * *